US012808372B2

(12) United States Patent
Kay

(10) Patent No.: US 12,808,372 B2
(45) Date of Patent: Nov. 24, 2026

(54) FASTENER SEAL

(71) Applicant: GD Energy Products, LLC, Tulsa, OK (US)

(72) Inventor: Konner Casey Kay, Broken Arrow, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 75 days.

(21) Appl. No.: 18/545,425

(22) Filed: Dec. 19, 2023

(65) Prior Publication Data

US 2024/0240634 A1 Jul. 18, 2024

Related U.S. Application Data

(60) Provisional application No. 63/438,617, filed on Jan. 12, 2023.

(51) Int. Cl.

| | |
|---|---|
| ***F04B 53/16*** | (2006.01) |
| ***F04B 1/0538*** | (2020.01) |
| ***F04B 47/02*** | (2006.01) |
| ***F04B 53/00*** | (2006.01) |
| ***F04B 53/02*** | (2006.01) |

(52) U.S. Cl.

CPC ..... *F04B 53/164* (2013.01); *F04B 1/0538* (2013.01); *F04B 53/007* (2013.01); *F04B 47/02* (2013.01); *F04B 53/02* (2013.01)

(58) Field of Classification Search

CPC .... F04B 53/164; F04B 1/0538; F04B 53/007; F04B 47/02; F04B 53/02; F04B 53/16

See application file for complete search history.

(56) References Cited

U.S. PATENT DOCUMENTS

| | | | |
|---|---|---|---|
| 6,419,279 | B1 | 7/2002 | Latham |
| 8,079,600 | B2 | 12/2011 | Shojima |
| 8,181,972 | B2 | 5/2012 | Tsuji |
| 10,151,414 | B2 | 12/2018 | Micken et al. |
| 10,288,178 | B2 | 5/2019 | Nowell et al. |
| 10,591,070 | B2 | 3/2020 | Nowell et al. |
| 10,648,490 | B2 | 5/2020 | Foster et al. |
| 10,670,013 | B2 | 6/2020 | Foster et al. |
| 10,895,325 | B2 | 1/2021 | Nowell et al. |
| 10,907,738 | B2 | 2/2021 | Nowell et al. |
| 10,941,765 | B2 | 3/2021 | Nowell et al. |
| 10,941,866 | B2 | 3/2021 | Nowell et al. |
| 10,962,001 | B2 | 3/2021 | Nowell et al. |
| 11,078,903 | B2 | 8/2021 | Nowell et al. |

(Continued)

FOREIGN PATENT DOCUMENTS

JP 59182680 * 12/1984 ..... F04B 21/00

OTHER PUBLICATIONS

Wikipedia.org; Counterbore—Wikipedia; from wikipedia.org/wiki/Counterbore (Year: 2025).*

(Continued)

*Primary Examiner* — David N Brandt

(74) *Attorney, Agent, or Firm* — Edell, Shapiro & Finnan, LLC

(57) ABSTRACT

A sealing assembly for a fastener of a reciprocating pump is disclosed. The sealing assembly includes a seal disposed in a contoured groove or counterbore surrounding a fastener receptacle. The seal prevents fluid from entering the fastener receptacle and corroding a fastener.

20 Claims, 12 Drawing Sheets

(56) References Cited

U.S. PATENT DOCUMENTS

| | | | | |
|---|---|---|---|---|
| 11,143,315 | B2 | 10/2021 | Nowell et al. | |
| 11,408,419 | B2 | 8/2022 | Foster et al. | |
| 11,434,901 | B2 | 9/2022 | Nowell et al. | |
| 2018/0266573 | A1 | 9/2018 | Nowell et al. | |
| 2019/0178243 | A1 | 6/2019 | Nowell et al. | |
| 2019/0226589 | A1 | 7/2019 | Nowell et al. | |
| 2020/0182240 | A1* | 6/2020 | Nowell | F16J 15/184 |
| 2020/0347843 | A1* | 11/2020 | Mullins | F16J 15/184 |
| 2021/0095650 | A1 | 4/2021 | Nowell et al. | |
| 2021/0108734 | A1 | 4/2021 | Nowell et al. | |
| 2021/0215154 | A1 | 7/2021 | Nowell et al. | |
| 2021/0404561 | A1 | 12/2021 | Nowell et al. | |
| 2022/0260161 | A1 | 8/2022 | Nowell et al. | |
| 2023/0012666 | A1* | 1/2023 | Keith | F04B 53/22 |

OTHER PUBLICATIONS

Dovetail O-Ring Groove Design, 2 pages, https://www.sealanddesign.com/technical/o-ring-groove-design/o-ring-groove-design-dovetail/, accessed Oct. 21, 2022.

How to properly Install Full and Half Dovetail O-Rings, https://www.youtube.com/watch?v=Mj8TIIZ0u2Q, published Jun. 17, 2022.

* cited by examiner

SECTION A-A

SECTION B-B

SECTION G-G

DETAIL H

SECTION C-C

DETAIL F

SECTION D-D

DETAIL E

FASTENER SEAL

CROSS REFERENCE TO RELATED APPLICATIONS

This application claims priority to U.S. Provisional Application No. 63/438,617, filed Jan. 12, 2023, the entirety of which is incorporated herein by reference.

FIELD OF INVENTION

The present invention relates to the field of high pressure reciprocating pumps and, in particular, to sealing fasteners for coupling together components of a high pressure reciprocating pump.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. Both the fluid end and the power end are typically formed from a high number of components, at least some of which are secured together with fasteners. Each connection point creates an additional potential point of failure to the pump.

SUMMARY

The present application relates to techniques for sealing fastening elements, or couplers, of a fluid end and/or to a power end of a reciprocating pump. The techniques may be embodied as a sealing assembly for a power end, a fluid end, a reciprocating pump, or a portion of any of the foregoing. The sealing assembly may comprise a compliant member (e.g., seal, O-ring, etc.) disposed in a groove, or counterbore, extending around an opening that receives a fastening element (e.g., a bolt, stud, tie rod, etc.). The fastening element may engage the power end, the fluid end, and/or other components of the reciprocating pump. For example, the power end, the fluid end, and/or the reciprocating pump may include one or more mount plates that receive the fastening element. Additionally, the techniques presented herein may be embodied as a method for sealing fasteners, (also referred to as "couplers" and coupling elements) for one or more fluid ends, a power end, and/or other components of a high pressure reciprocating pump.

More specifically, in accordance with at least one embodiment, the present application is directed to a fluid end including a sealing assembly. The fluid end is configured to guide/deliver a fluid from an inlet bore to an outlet bore as a power end drives motion of a reciprocating element within a stuffing box. The sealing assembly may be disposed around openings that are disposed on an external surface of a casing of the fluid end and arranged to receive the stuffing box. Among other advantages, the sealing assembly prevents fluid from entering the openings and corroding the coupling elements.

BRIEF DESCRIPTION OF THE DRAWINGS

To complete the description and in order to provide for a better understanding of the techniques presented in this application, a set of drawings is provided. The drawings form an integral part of the description and illustrate an embodiment of the present application, which should not be interpreted as restricting the scope of the present application, but just as an example of how the techniques presented herein can be carried out. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a sealing assembly for coupling elements of a reciprocating pump. The reciprocating pump may have a one or more fluids (e.g., lubricating oil for lubricating moving parts, working fluid to be pressurized by the pump, etc.) that may leak or weep from their designated fluid spaces or volumes. For example, the fluid end may include a fluid chamber that interconnects multiple bores, including a reciprocation bore for receiving a reciprocating element that acts on working fluid in or moving through the fluid chamber. The fluid chamber and reciprocation bore may be closed to an ambient environment by one or more seals (e.g., packing seals in the reciprocation bore), but the working fluid may leak past the seals and trickle into interstitial spaces (which may created and/or defined by micro gaps, surface irregularities, offset couplings, wear, etc.) between the fluid end and another element (e.g., a flange, a plate, module casing, etc.). In such instances, the working fluid may find its way to an opening for receiving a coupling element (e.g., a stud, a bolt, a tie rod, etc.) that fixes the fluid end and other element together. When the working fluid contacts these coupling elements, the working fluid may corrode the coupling element and eventually cause it to fail. The sealing assembly presented herein seals the coupling element and/or coupler opening from the interstitial spaces to prevent the working fluid from contacting and corroding the coupling element. Moreover, the sealing assembly may guide the working fluid around the coupler opening for the coupling element and allow the fluid to weep or trickle from the interstitial spaces to a weep area, or otherwise, to an exterior of the reciprocating pump 100.

Figure 1A:
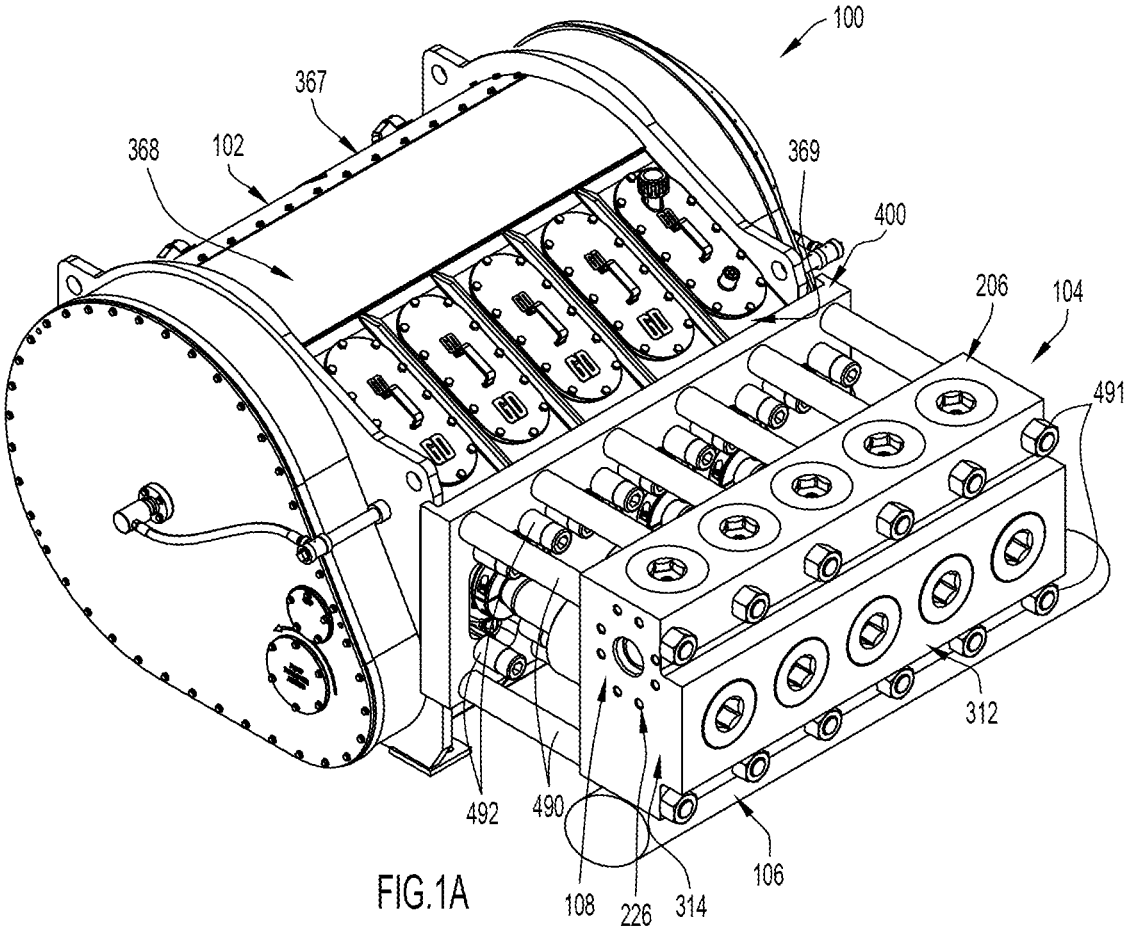
FIG. 1A is a front perspective view of a reciprocating pump, according to an example embodiment.
Figure 1B:
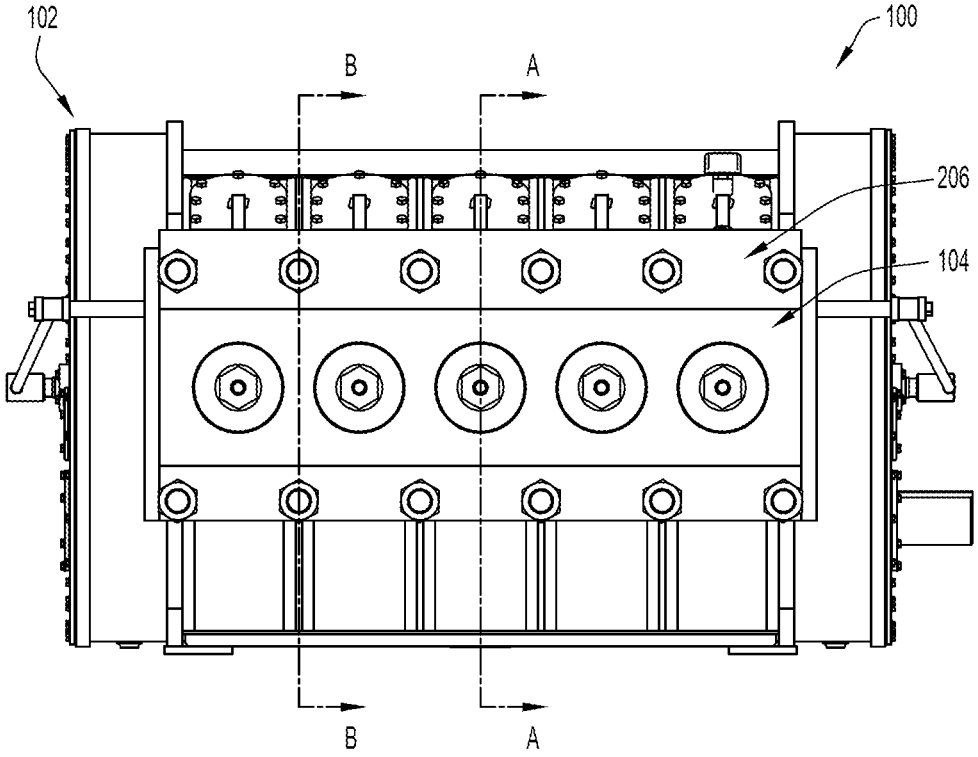
FIG. 1B is a front view of the reciprocating pump of FIG. 1A.

Referring to FIGS. 1A and 1B, a reciprocating pump 100 is illustrated. The reciprocating pump 100 includes a power end 102 and a fluid end 104. The power end 102 includes a crankshaft 103 (see FIG. 3) that drives a plurality of reciprocating plungers or pistons 202 (generally referred to as "reciprocating elements") within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking fluid (e.g., a mixture of water and sand) is injected into rock formations at high pressures to allow natural oil and gas to be extracted from the rock formations. However, to be clear, this example is not intended to be limiting and the present application may be applicable to both fracking and drilling operations. At the same time, the present invention may also offer some specific advantages for isolating coupling elements from working fluids of other machines.

Often, the reciprocating pump 100 may be quite large and may for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time needed to complete maintenance operations (minimizing downtime) are highly desirable. The techniques presented herein extend the life of the couplers by sealing the receiving openings the reciprocating pump 100 to prevent fluid from contacting the couplers. The sealing arrangements are discussed in further detail below.

Figure 2:
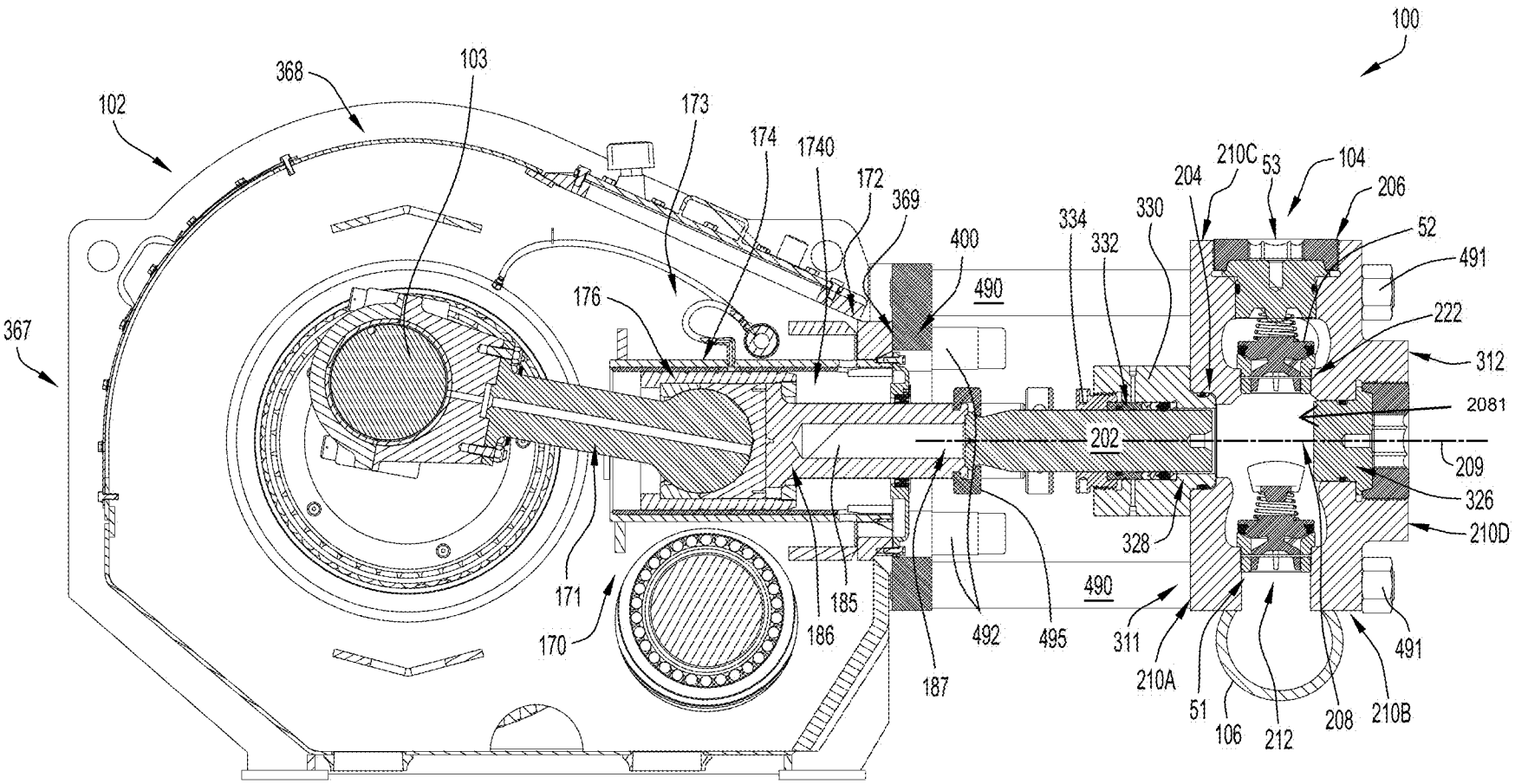
FIG. 2 is a cross-sectional view of the reciprocating pump taken along line A-A of FIG. 1B.

Still referring to FIGS. 1A and 1B, but now in combination with FIG. 2, the reciprocating pump 100 pumps fluid into and out of pumping chambers 208. FIG. 2 shows a side, cross-sectional view of reciprocating pump 100 taken along line A-A on FIG. 1B. Thus, FIG. 2 depicts a single pumping chamber 208 with a central axis 209 coaxial with the reciprocating elements 202 included in reciprocating pump 100. However, it should be understood that a fluid end 104 can include multiple pumping chambers 208 arranged side-by-side. In fact, in at least some embodiments (e.g., the embodiment of FIGS. 1A, 1B, and 2), a casing 206 of the fluid end 104 forms a plurality of pumping chambers 208 (e.g., with a plurality of bore pairs 2081) and each chamber 208 includes a reciprocating element 202 that reciprocates within the casing 206. Moreover, side-by-side pumping chambers 208 need not be defined by a single casing 206. For example, in some embodiments, the fluid end 104 may be modular and different casing segments may house one or more pumping chambers 208.

In any case, the one or more pumping chambers 208 are arranged side-by-side so that corresponding conduits are positioned adjacent each other and generate substantially parallel pumping action. Specifically, with each stroke of the reciprocating element 202, low pressure fluid is drawn into the pumping chamber 208 and high pressure fluid is discharged. But, often, the fluid within the pumping chamber 208 contains abrasive material (e.g., "debris" and/or proppant) that can damage seals formed in the reciprocating pump 100, such as the "packing seals" surrounding a reciprocating element 202 of a fracking fluid end. Consequently, the damage creates a path for the fluid to weep (or otherwise leak) from the pumping chamber 208 and a need for continued maintenance.

In various embodiments, the fluid end 104 may be shaped differently and/or have different features, but may still generally perform the same functions, define similar structures, and house similar components. For example, while fluid end 104 includes a first bore 204 (also referred to as reciprocation bore 204) that is aligned perpendicularly with an inlet bore 212 and an outlet bore 222, other fluid ends may include any number of bores arranged along any desired angle or angles, for example, to intersect an axis of bore 204 (and/or an access bore 326) substantially at an askew angle and/or so that two or more bores are substantially orthogonal. Generally, bores 204, 212, 222, and 326, as well as any other bores (i.e., segments, conduits, etc.), may intersect to form the pumping chamber 208, may be cylindrical or non-cylindrical, and may define openings at an external surface 210A, 210B, 210C, 210D of the casing 206. Additionally, bores 212, 222, and 326, as well as any other bores (i.e., segments, conduits, etc.), may receive various components or structures, such as sealing assemblies or components thereof. However, the shape, orientation, alignment, etc. of the external surfaces 210A-210D of the fluid end 104 and bores 204, 212, 222, and 326 are merely examples and, in other embodiments, the fluid end 104 may include any desirable features, components, shaping, alignment, etc.

In the depicted embodiment, inlet bore 212 defines a fluid path through the fluid end 104 that connects the pumping chamber to a piping system 106 delivering fluid to the fluid end 104. Meanwhile, outlet bore 222 allows compressed fluid to exit the fluid end 104. Thus, in operation, bores 212 and 222 may include valve components 51 and 52, respectively, (e.g., one-way valves) that allow bores 212 and 222 to selectively open and deliver a fluid through the fluid end 104.

In operation, fluid may enter fluid end 104 via outer openings of inlet bores 212 and exit fluid end 104 via outer openings of outlet bores 222. More specifically, fluid may enter inlet bores 212 via pipes of piping system 106, flow through pumping chamber 208 (due to reciprocation of a reciprocating elements 202), and then flows through outlet bores 222 into a channel 108 (see FIG. 1A). However, piping system 106 and channel 108 are merely example conduits and, in various embodiments, fluid end 104 may receive and discharge fluid via any number of pipes and/or conduits, along pathways of any desirable size or shape. A discharge flange.

Meanwhile, each of bores 204 defines, at least in part, a cylinder for reciprocating elements 202, and/or connects the casing 206 to a cylinder for reciprocating elements 202. More specifically, in the illustrated embodiment, a stuffing box 330 is removably coupled to casing 206. The stuffing box 330 houses packing seals 332 configured to seal against a reciprocating element 202 disposed interiorly of the stuffing box 330. A retaining ring 334 prevents the packing seals 332 from exiting the stuffing box 330. Reciprocation of a reciprocating element 202 in or adjacent to bore 204, which may be referred to as a reciprocation bore (or, for fracking applications, a plunger bore), draws fluid into the pumping chamber 208 via inlet bore 212 and pumps the fluid out of the pumping chamber 208 via outlet bore 222.

To operate properly, the stuffing box 330 must be securely and stably coupled to the fluid end 104, and the fluid end 104 must be securely and stably coupled to the power end 102. Thus, in the depicted embodiment, the stuffing box 330 is bolted to the fluid end casing 206 with a plurality of couplers (e.g., bolts, studs, etc.). Further, the fluid end 104 is coupled to a mount plate 400 with couplers 490, and the mount plate 400 couples to the power end 102 with couplers 492. Consequently, in the depicted embodiment, the mount plate 400 and couplers 490, 492 couple the fluid end 104 to the power end 102.

More specifically, in the depicted embodiment, the first set of couplers 490 fasten to the mount plate 400 and extend through receiving openings in the fluid end 104 to couple the fluid end 104 to the mount plate 400. Meanwhile, couplers 492 couple the mount plate 400 to receiving openings in a front end of the power end 102. Couplers 490 and 492, may be studs, bolts, screws, and/or tie rods, which are sometimes referred to as stay rods, that engage or pass through a corresponding receptacle and/or through hole. For example, couplers 490 may be stay rods that, at one end, are threaded to or bolted onto the mount plate 400, and at the opposite end, are secured against the fluid end 104 with securing elements 491 (e.g., nuts).

Regardless of the coupler type/composition, couplers 490, 492, may be corroded due to exposure to contaminates that seep into the receiving openings. For example, at the power end 102, lubricating fluid and/or other fluids (potentially including working fluid) may contaminate the outer surface of the power end 102 and/or mount plate 400, seep into the receiving openings, and corrode couplers 490, couplers 492, and/or or other couplers included in power end 102. Similarly, at the fluid end 104, working fluid and/or other fluids (potentially including lubricating fluid) may contaminate the outer surface of the fluid end 104, seep into the receiving openings, and corrode couplers 490 and/or other couplers included in fluid end 104. In any case, when couplers are corroded, the reciprocating pump 100 must be shut down for maintenance to replace the couplers.

Still referring to FIGS. 1A, 1B, and 2, in the depicted reciprocating pump 100—and in most high pressure reciprocating pumps—the crosshead frame 174 is a part of a crosshead assembly 170 that converts rotational motion of the crankshaft 103 into linear, reciprocating motion of a pony rod 185. More specifically, the crosshead assembly 170 includes a connecting rod 171, a crosshead 173, and a pony rod 185. The crosshead 173 includes a connector 176 disposed within a crosshead frame 174 and the connecting rod 171 extends from the crankshaft 103 to the connector 176. The connector 176 is configured to move linearly within the crosshead frame 174 and opposite ends of the connecting rod 171 are configured to travel with the crankshaft 103 and the connector 176.

Thus, as the connecting rod 171 rotates with the crankshaft 103, it reciprocates the connector 176 within the crosshead frame 174. The connector 176 is also connected to a back side 186 of the pony rod 185 so that the pony rod 185 reciprocates with the connector 176. Meanwhile, a front side 187 of the pony rod 185 can be coupled to a reciprocating element 202 (e.g., a plunger), such as via a clamp 495, to drive reciprocating motion of the reciprocating element 202 that pumps fluid through the fluid end 104. Notably, during this action, the pony rod 185 and/or the crosshead 173 exert forces on the front 369 of the frame 368, which in the specific embodiment depicted in FIGS. 1A, 1B, and 2, is defined, at least in part, by nose plate 172. These forces stress the frame 368 and/or the nose plate 172 (and potentially the crosshead frame 174). Thus, in embodiments where a nose plate 172 defines at least a portion of the front 369 of a frame 368, the nose plate 172 is usually irremovably coupled to the crosshead frame 174 to remain structurally sound during operation of the reciprocating pump 100. Additionally or alternatively, a front 369 of frame 368 may be irremovably coupled to other portions of an overall frame for the power end 102.

In the depicted embodiment, the couplers 492 are threaded to receptacles in the nose plate 172 to position, mount, or clamp, the mount plate 400 to the power end 102. Thus, the nose plate 172 defines the locations of the receptacles for the power end 102 (which is positioned at and/or generally defines a front of the power end 102). Thus, the first set of couplers 492 needs to be positioned to match a configuration of the receptacles included on the front 369 of frame 368 (e.g., on the nose plate 172). However, in other embodiments, receptacles could be included in any part or portion of a power end 102. That is, the power end 102 may include a frame 368 that extends from a front 369 to a back 367 and the receptacles may generally be included in the front 369 of frame 368.

The receptacles may extend into the nose plate 172 from a front surface and may be generally disposed around pony rods bores 1740. However, in other embodiments, the receptacles need not be positioned as such. In any case, the receptacles may be threaded so that a threaded coupler 492 can be secured directly therein. Still further, in some instances, receptacles need not extend through back surface of the nose plate 172, which may prevent couplers 492 from extending into the crosshead assembly 170 and interfering with operations of the crosshead assembly 170 and/or allowing contaminants into the crosshead assembly 170. However, other embodiments might include receptacles that are through holes.

Still referring to FIG. 2, the stuffing box 330 may entirely support packing assembly 332 (e.g., seals) for preventing the working fluid from leaking past the reciprocating element 202. Additionally, seals may be disposed between the stuffing box 330 and the casing 206. Over time, the packing assembly 332 and/or seals may wear and/or fail over time, and thus, must be accessed for maintenance and/or replacement. Other components, such as valve components 51 and/or 52, or the fluid end casing 206 itself may also wear and/or fail and require repair or replacement over time. To help provide access to these parts and/or the pumping chamber, the depicted fluid ends 104 includes access bores 326 that is aligned with (and coaxial with) the reciprocating bore 204. In some implementations, the fluid end does not include an access bore 326. Regardless of whether the fluid end 104 includes an access bore 326, seals disposed throughout the reciprocating pump 100 may need to be replaced.

Prior to replacing a worn seal, fluid may leak from the stuffing box 330, casing 206, the fluid end 104, and/or power end 102 and contaminate one or more couplers of the fluid end 104 and/or power end 102. The fluid may corrode the couplers and cause excess wear impacting the coupling between the power end 102 and the fluid end 104. Consequently, the reciprocating pump 100 must be taken offline to replace the worn couplers.

To prevent contamination of the couplers, a sealing assembly may be disposed about a coupler opening or receptacle at one or more surfaces of the stuffing box 330, fluid end casing 206, mount plate 400, and power end 102. That is any receptacles that receive a coupler may further include a counterbore, or groove, for receiving a seal (e.g., an O-ring). The seal engages an inner surface of the groove and another outer surface to prevent, or at least restrict, fluid from contacting the corresponding coupler.

Figure 3:
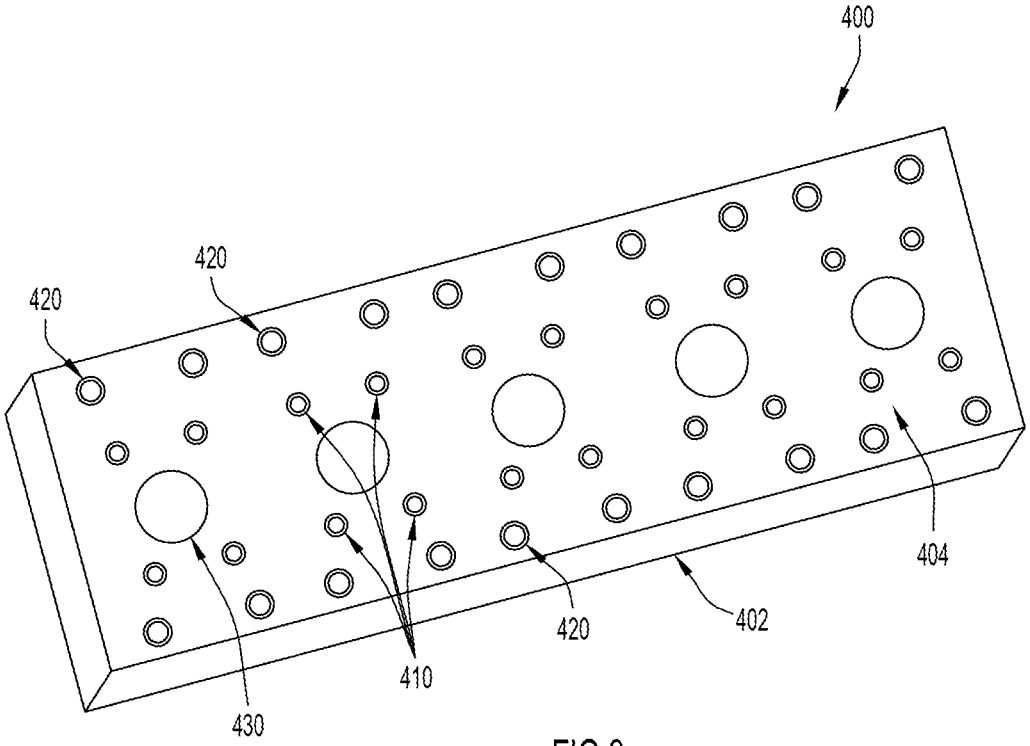
FIG. 3 is a perspective view of a mount plate of the reciprocating pump of FIG. 1A.
Figure 4:
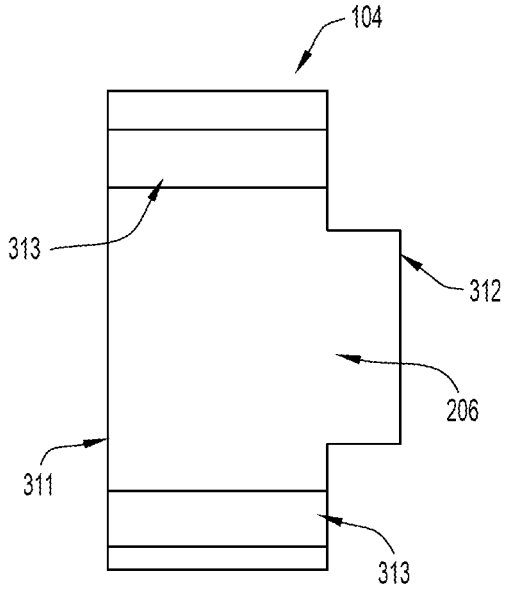
FIG. 4 is a cross-sectional view of a fluid end casing of the reciprocating pump taken along line B-B of FIG. 1B.

Now turning to FIGS. 3 and 4, receptacles for receiving the couplers and sealing assemblies are depicted. FIG. 3 illustrates a perspective view of the of the mount plate 400 independent of reciprocating pump 100. FIG. 4 depicts a cross-sectional side view of the fluid end 104 taken along line B-B of FIG. 1B.

Referring to FIG. 3, the mount plate 400 includes at least a first set of openings 410 and a second set of openings 420 and a third set of openings 430. The first set of openings 410 is configured to receive a first set of couplers 492, e.g., bolts, which couple the mount plate 400 to the power end 102 of the reciprocating pump 100. The second set of openings 420 is configured to receive a second set of couplers 490, e.g., tie rods, which couple the mount plate 400 to the fluid end 104 in a spaced relationship. In some embodiments, both the first set of openings 410 and the second set of openings 420 extend through the mount plate 400, from a front surface 404 of a main body of the mount plate 400 to a back surface 402 of the main body of the mount plate 400. However, in other embodiments, the first set of openings 410 and/or the second set of openings 420 need not be through holes. For example, openings 410 might be accessible from only the front surface 404 of the mount plate 400 (e.g., if couplers 490 thread into the front surface 404) and/or openings 420 might be accessible from only the back surface 402 of the mount plate 400 (e.g., if couplers 492 thread into the back surface 402). Additionally, the third set of openings are configured to receive the pony rod 185.

Generally, openings 410 and openings 420 may be sized to receive their respective couplers. Thus, in some embodiments, openings 410 are larger than openings 420, but in other embodiments the opposite may be true. Alternatively, openings 410 and/or openings 420 need not be constantly sized and can vary with respect to other openings of their set or with respect to openings of other sets. In the embodiment of FIG. 3, openings 420 are generally larger than openings 410 and the openings 420 are positioned exteriorly of openings 410 (or, from another perspective, openings 410 are positioned interiorly of openings 420). In the depicted embodiment, the openings 410 and 420 each include a sealing assembly 600 to prevent, or at least restrict, fluid from entering, contacting, and ultimately, corroding the couplers 490, 492. However, other embodiments might only include sealing assemblies 600 on a subset of openings (e.g., only openings 420, only a portion of openings 420, etc.). Additionally or alternatively, sealing assemblies 600 may be disposed on one or both of the front surface 404 and the back surface 402. The sealing assembly 600 is discussed in further detail below with reference to at least FIGS. 9-11.

Turning to FIG. 4, the fluid end 104 includes through holes 313 extending through the casing 206 from a rear side 311 to a front side 312. In at least some instances, each through hole 313 receives a coupler 490 and a sealing assembly (see FIGS. 9-11) to prevent, or at least restrict, the entry of fluid from contaminating the coupler 490. Sealing assemblies may be disposed on one or both of the rear side 311 and the front side 312 of the through holes 313.

Figure 5:
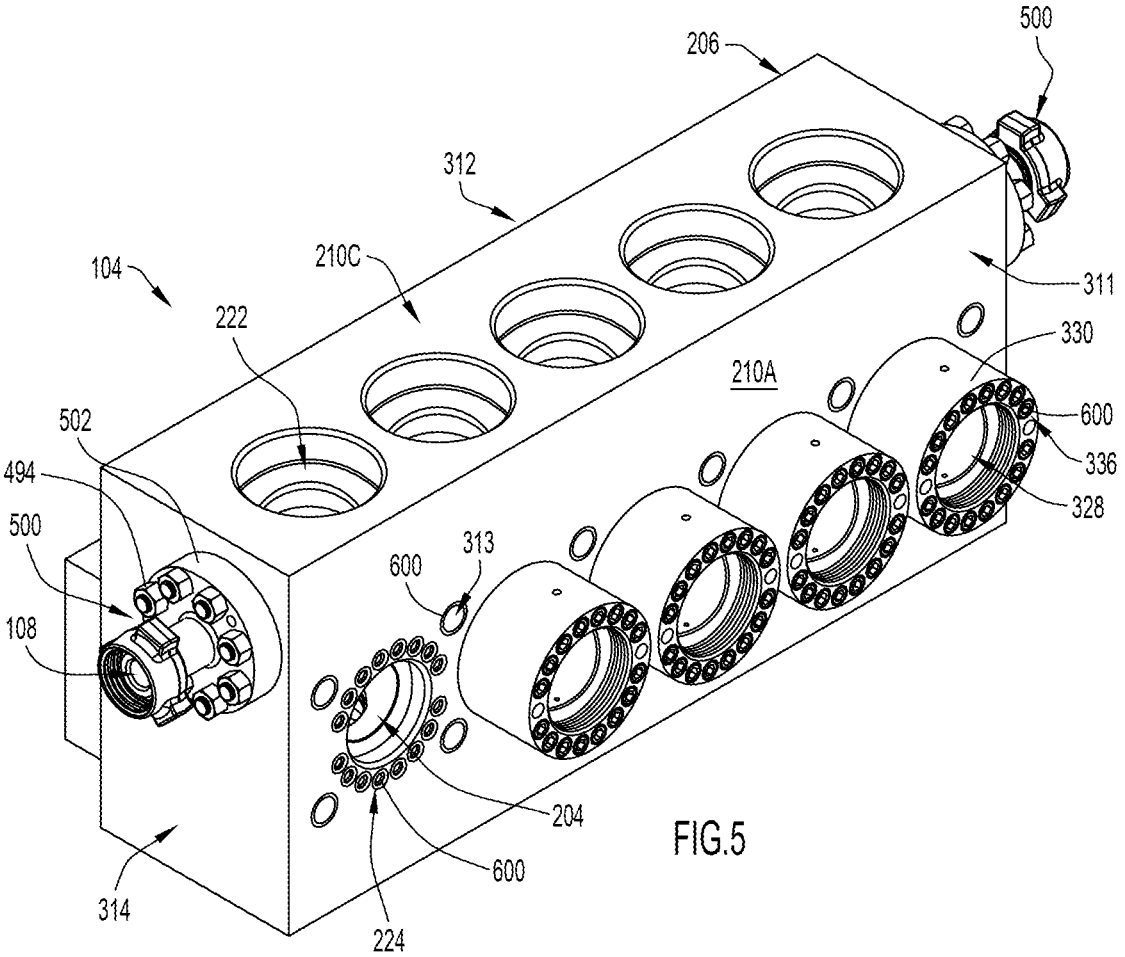
FIG. 5 is a rear perspective view of the fluid end of the reciprocating pump of FIG. 1A in isolation.
Figure 6:
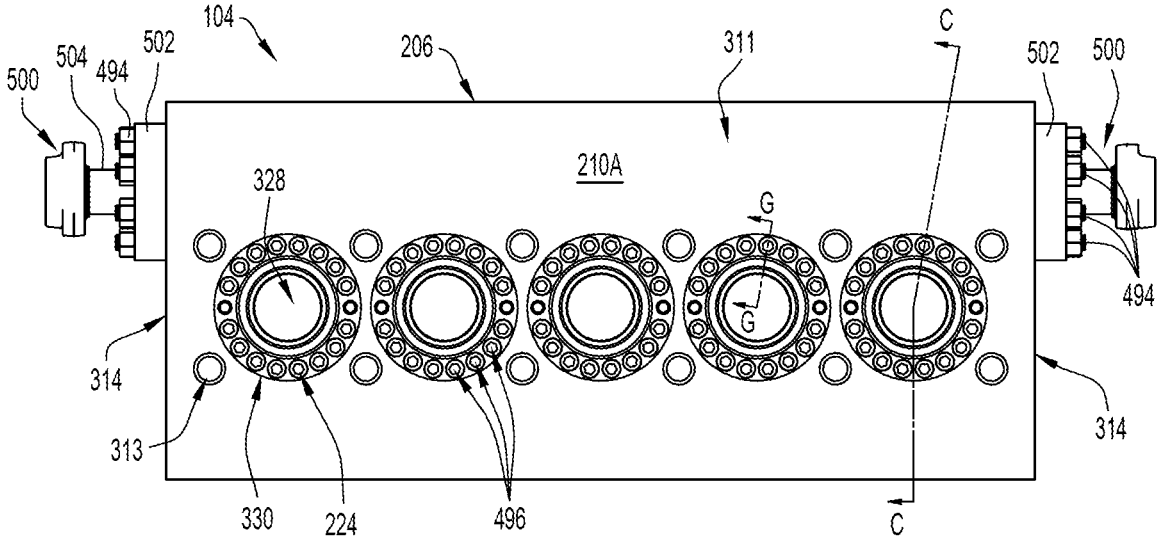
FIG. 6 is a rear view of the fluid end of FIG. 5.

Now referring to FIGS. 5 and 6, the fluid end 104 is depicted in isolation with the closure assemblies 53 and one stuffing box 330 omitted for clarity. FIG. 5 is a rear perspective view of fluid end 104, and FIG. 6 is a rear view of the fluid end 104. In the depicted embodiment, stuffing boxes 330 are mounted to the rear side 311 of the casing 206 and discharge elements 500 are mounted to the lateral sides 314 of the casing 206. Additionally, holes 313 for receiving the couplers 490 from the power end 102 extend through the casing 206 and are disposed radially about each stuffing box 330.

Each stuffing box 330 is fixed to rear surface 210A of the casing 206 via a plurality of couplers 496 (e.g., bolts, studs, etc.). The plurality of couplers 496 extend through a plurality of openings 336 of the stuffing box 330 and engage openings 224 on the rear side 311 of the casing 206. That is, each coupler 496 extends through the stuffing box 330 via a corresponding opening 336 to engage a corresponding opening 224, or receptacle, on the rear side 311 of the casing 206. Thus, each stuffing box 330 is mounted to the rear side 311 of the casing 206.

Moreover, each stuffing box 330 includes a stuffing bore 328 that is co-axial with a corresponding reciprocating bore 204 for guiding a corresponding reciprocating element 202. The stuffing bore 328 may receive a portion of the working fluid from the pumping chamber 208, e.g., during a suction stroke of the reciprocating element 202. As mentioned above, the working fluid is sealed within the stuffing bore 328 via the packing seals 332 (See FIG. 2).

Meanwhile, the discharge elements 500 are coupled to the lateral sides 314 via a plurality of bolts 494. The discharge elements 500 include a discharge flange 502 having a plurality of openings, or receptacles, for receiving the plurality of couplers 494 and a discharge body 504 extending from the flange 502. The couplers 494 extend through the flange 502 and engage a plurality of openings 226 in the lateral side 314 of the casing 206 (see FIG. 1A). The discharge body 504 extends laterally form the discharge flange 502 and may extend the channels 108 when mounted to the casing 206.

As noted above, the fluid end 104 includes seals in bores 204, 222, 326, 212, 328 (and between casing portions if the casing is formed from multiple portions or modules) to prevent, or at least restrict, working fluid from the pumping chamber 208 from leaking to the exterior of the fluid end 104. However, as the seals wear, some working fluid may leak into interstitial spaces 700 (see FIGS. 7B and 8B below) and/or onto an exterior of the fluid end casing 206. Then, the working fluid may leak into the coupler openings 224, 226, 313, 336, (including discharge flange 502 coupler openings and/or mount plate openings 410, 420). If the working fluid reaches these openings the working fluid may corrode the couplers disposed therein (e.g., couplers 490, 492, 494, and/or 496). The corrosion of couplers may cause excess wear and require that the contaminated couplers be replaced.

To prevent, or at least restrict, contamination of the couplers 490, 492, and 494, each coupler opening 224, 226, 313, 336, 410, 420 may include a sealing assembly. The one or more seal assemblies may be disposed at the coupler openings 224, 226, 313, 336, 410, and/or 420 at an external surface of the fluid end casing 206, stuffing box 330, discharge elements 500, mounting plate 400, and/or power end frame 368. The sealing assembly is discussed in further detail below with reference to FIGS. 7A-11.

Figure 7A:
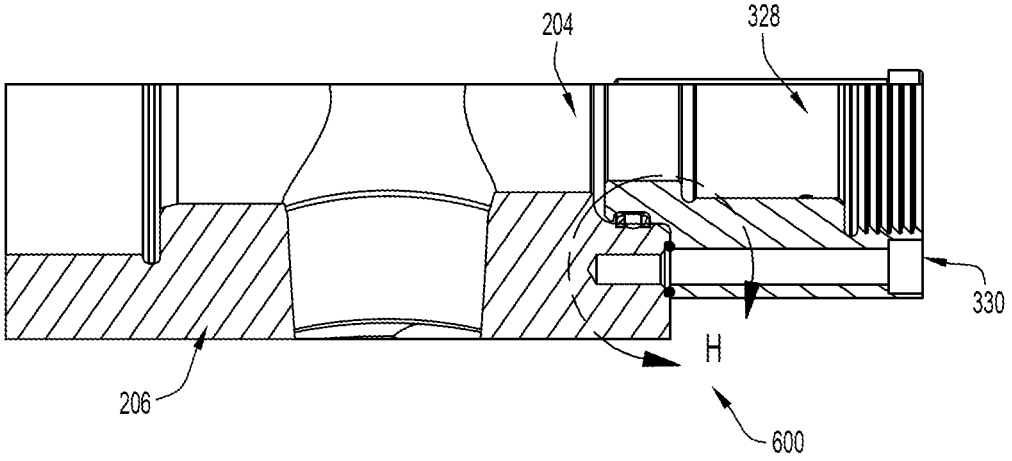
FIG. 7A is a partial cross-sectional view of the fluid end taken along line G-G of FIG. 6.
Figure 7B:
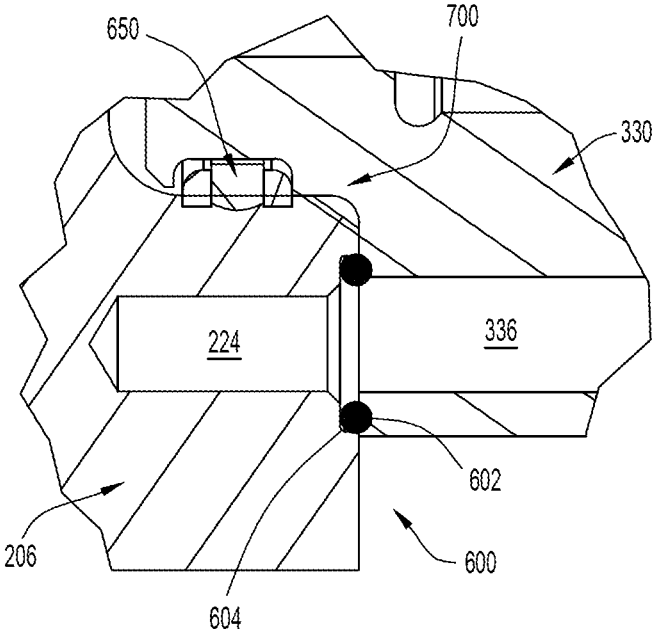
FIG. 7B is a detail view of region H of FIG. 7A.
Figure 8A:
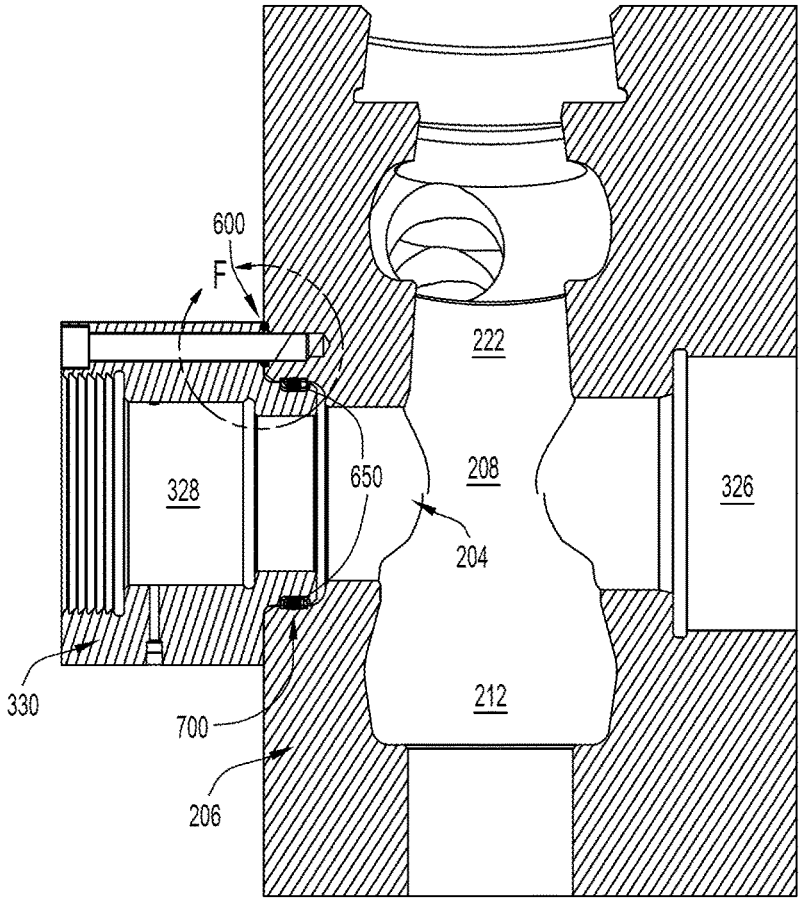
FIG. 8A is a cross-sectional view of the fluid end taken along line C-C of FIG. 6.
Figure 8B:
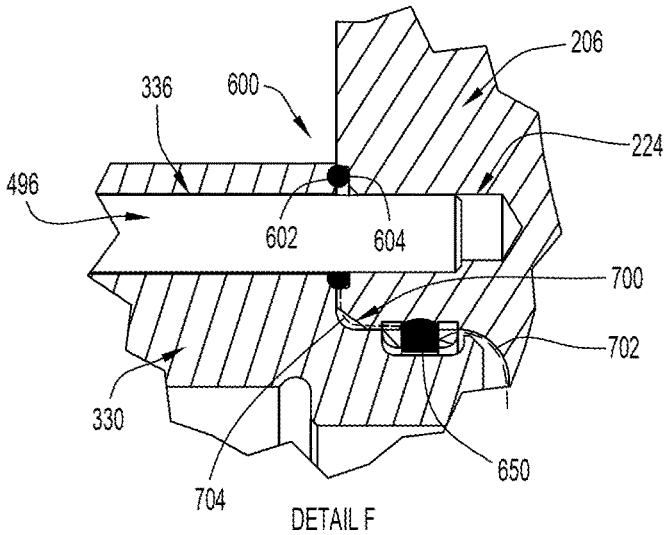
FIG. 8B is a detail view of region F of FIG. 8A.

FIGS. 7A, 7B, 8A, and 8B depict a seal assembly 600 disposed about each coupler between the rear side 311 of the casing 206 and the stuffing box 330. 7A is a partial cross-sectional view of the fluid end taken along line G-G of FIG. 6 with the coupler 496 omitted for clarity, and FIG. 7B is a detail view of region H shown in FIG. 7A. FIG. 8A is a cross-sectional view of the fluid end 104 taken along line C-C of FIG. 6, and FIG. 8B is a detail view of region F shown in FIG. 8A. As best illustrated in FIGS. 7B and 8B, each sealing assembly 600 includes a compliant member 602 (e.g., an O-ring or another type of seal) disposed in a counterbore 604 about a coupler opening 224. As depicted in FIG. 8B, each compliant member 602 (which may also be referred to herein as seal 602) may contact an outer surface of each coupler 496 and opposing surfaces of the casing 206 and stuffing box 330.

Referring to FIG. 8B, during operation, working fluid 702 may leak past a seal 650 disposed between the casing 206 and stuffing box 330. The leaked fluid 704 may follow a weep path, or path of least resistance, through the interstitial spaces 700. The sealing assembly 600 prevents, or at least restricts, the leaked fluid 704 from contacting the couplers 496. For example, the seal 602 surrounds the coupler 496 and prevents, or at least restricts, the fluid from leaking into the coupler opening 224 and/or 336. Meanwhile, the counterbore 604 and/or space between sealing assemblies 600 may guide the leaked fluid 704 away from the openings 224 and 336 to a weep area or otherwise, to an exterior of the fluid end 102.

Figure 9:
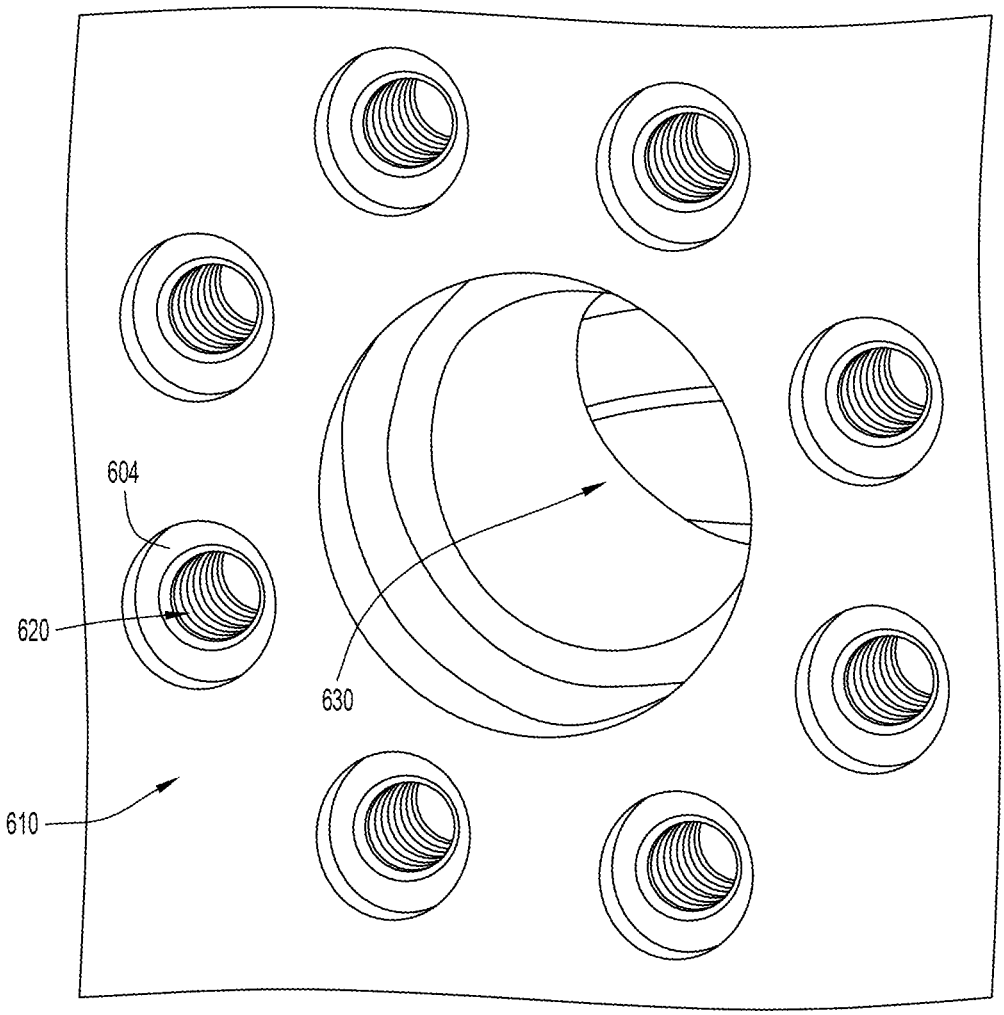
FIG. 9 is a perspective view of a body with counterbore/groove for sealing assembly, according to an example embodiment.
Figure 10:
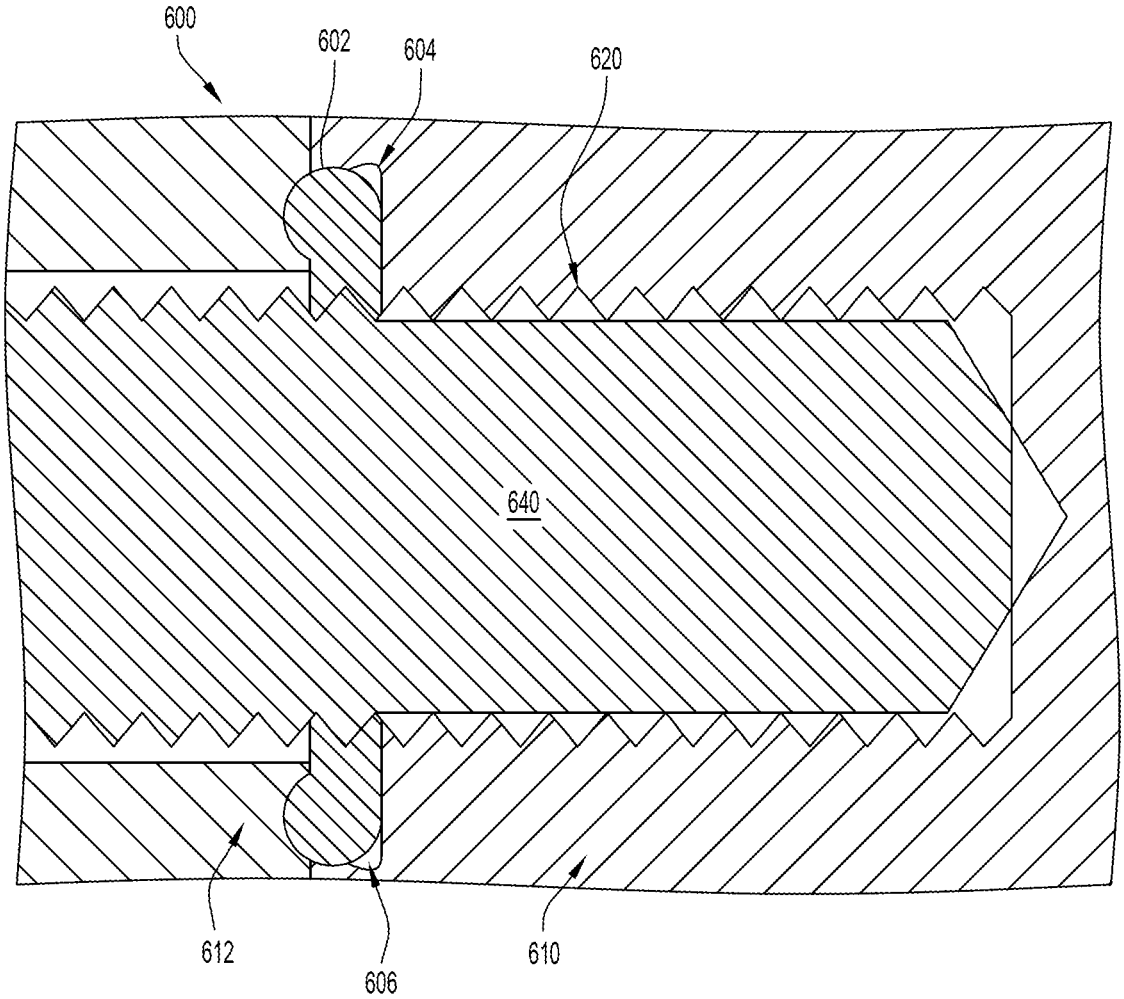
FIG. 10 is a cross-sectional view of a sealing assembly according to an example embodiment.

Now referring to FIGS. 9 and 10, a detailed view of the sealing assembly 600 is illustrated. FIG. 9 depicts a body 610 having a plurality of coupler openings 620 radially disposed about a bore 630. Each coupler opening 620 is surrounded by a coaxial counterbore or groove 604. The groove 604 provides a seat for receiving a seal 602 (e.g., an O-ring). The body 610 may be representative of at least a portion of a wide variety of components of a reciprocating pump, such as a fluid end body like casing 206, and/or a mount plate like mount plate 400.

FIG. 10 provides a detailed view of the sealing assembly 600 disposed between a mating body 612 coupled to the body 610 via a coupler 640. In the depicted embodiment, the sealing assembly 600 includes a seal 602 disposed in a counterbore 604 having a dovetail shape and surrounding the coupler opening 620 and the coupler 640. The seal 602 may substantially fill the counterbore 604 and engage the coupler 640 to prevent, or at least restrict, fluid from entering the coupler opening 620 and contacting the coupler 640. Meanwhile, the dovetail shape of the counterbore helps to retain the seal 602 by creating an increased retaining force (e.g., as compared other shapes). In some instances, the dovetail shape might also, but need not, define a space 606 to guide a fluid (e.g., leaked fluid 704 of FIG. 8B) away from the seal 602 and the coupler 640. In theses instances, the space 606 may be fluidly connected to weep channels that guide the fluid to the ambient environment. For example, the interstitial spaces 700 (see FIG. 8B) may fluidly couple the space 606 to the weep channels. In some instances, the coupler 640 may be representative of couplers 490, 492, 494, and 496.

Figure 11:
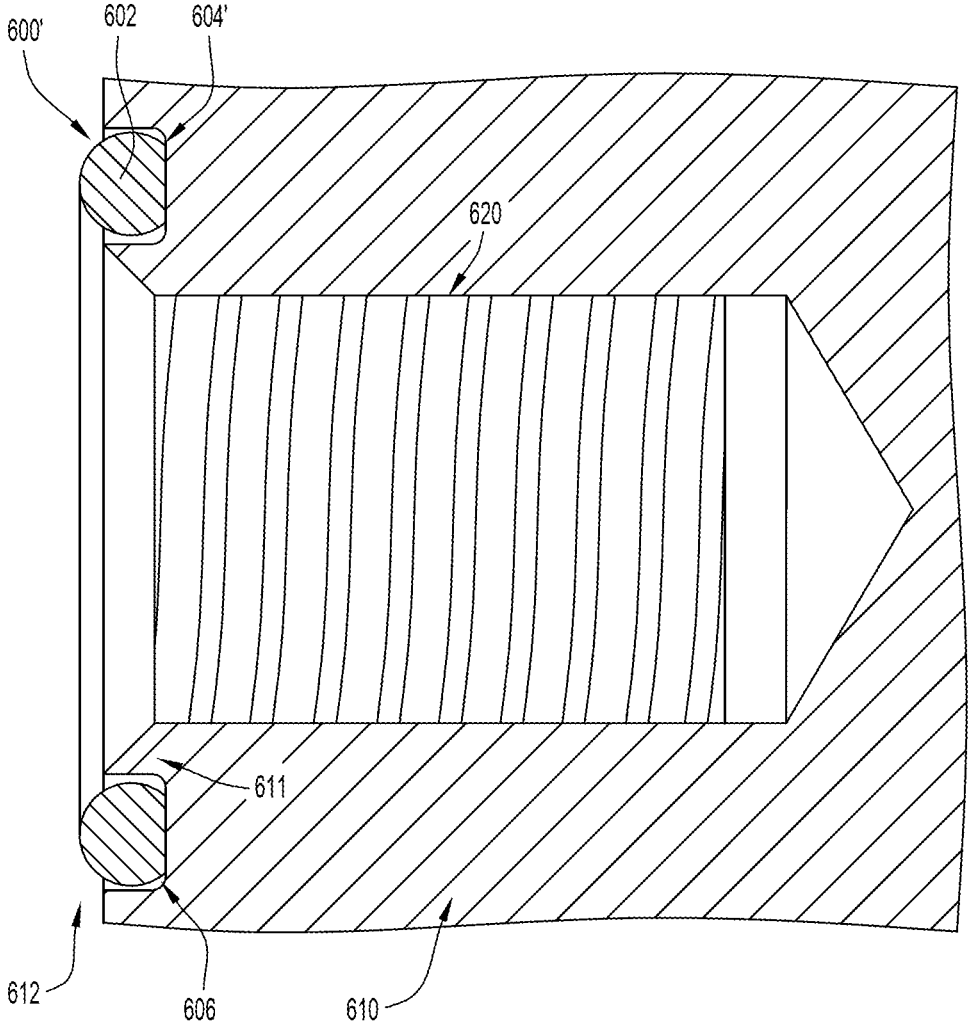
FIG. 11 is a cross-sectional view of a sealing assembly according to another example embodiment.

Now turning to FIG. 11, a second embodiment of a sealing assembly 600' is depicted. The sealing assembly 600' is substantially similar to sealing assembly 600 of FIG. 10, except that rather than a counter bore, the seal 602 is disposed in a groove 604' that is separated from the coupler opening 620. That is, a portion 611 of the body 610 is disposed between the coupler opening 620 and the groove 604'. Consequently, the seal 602 does not engage the coupler 640. Instead, the seal 602 engages the outer surfaces of groove 604' (defined by the body 610) and an outer surface of the mating body 612. Further, the groove 604' may guide fluid (e.g., leaked fluid from a fluid containing bore) away from the coupler opening 620 and coupler 640, allowing the fluid to weep to the ambient environment (e.g., via weep channels or interstitial spaces). Thus, the sealing assembly 600' prevents leaked fluid (e.g., leaked fluid 704 of FIG. 8B) from entering the coupler opening 620 contacting a coupler 640 disposed in the coupler opening 620. Accordingly, the sealing assembly prevents corrosion of coupler 640 and extends the life of the coupler 640.

The body 610 may be representative of the rear side 311 of the fluid end casing 206, the lateral sides 314 of the fluid end casing 206, a front and/or a rear side of stuffing box 330, a front and/or a rear side of the mount plate 400, and/or a front 369 of the frame 368 of the power end 102. Meanwhile, the mating body 612 may be representative of any surface (e.g., of any component) configured to engage the surfaces of which body 610 may be representative. For example, the mating body 612 may be representative of a stuffing box and/or a nut for threading onto the coupler or the head of a bolt-type coupler. Meanwhile the coupler opening 620 may be representative of openings, or receptacles, 224, 226, 313, 336, 410, and/or 420, or any other coupler receiving element of a reciprocating pump. Additionally, the bore 630 may be representative of bores/openings 204, 212, 222, 326, 328, 430 or any other bores of a reciprocating pump. Said another way, the sealing assembly 600 may be disposed about any coupler and/or coupler opening/receptacle and between any two mating surfaces of a reciprocating pump.

Moreover, the sealing assembly 600, 600' may be disposed on body 610 and/or the mating body 612. That is, the groove 604, 604' may be defined by the body 610, the mating body 612, or both the body 610 and the mating body 612. For example, an entirety of the groove 604, 604' may be disposed in the body 610 or an entirety the groove 604, 604' may be disposed in the mating body 612. Alternatively, a first portion of the groove 604, 604' may be disposed in the body 610 and a second portion of the groove 604, 604' may be disposed in the mating body 612. Thus, both the of the body 610 and mating body 612 receive a portion of the seal 602. Therefore, the sealing assembly 600, 600' may be disposed on either of the body 610 and/or the mating body 612.

Figure 12A:
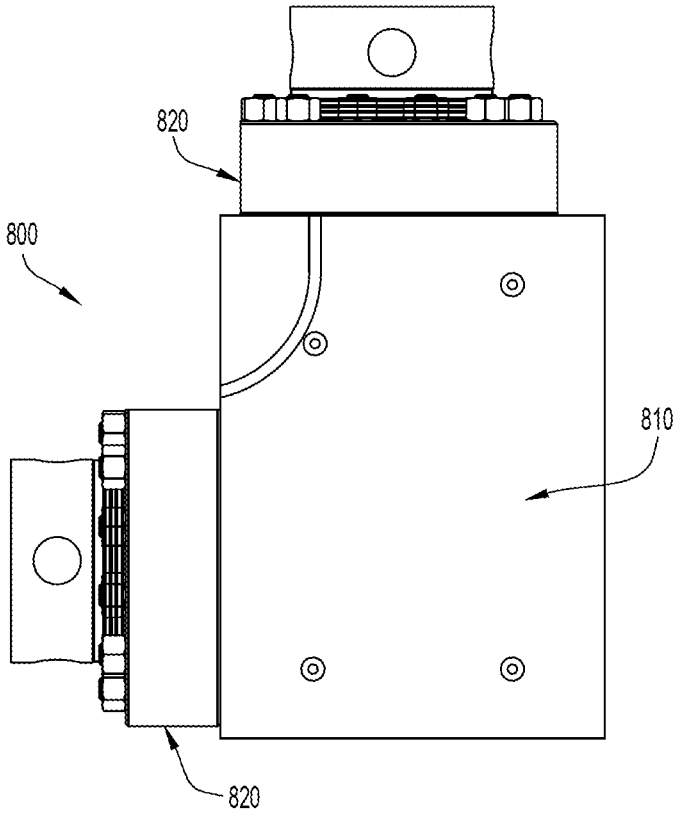
FIG. 12A is a first side view of a casing mount with one or more seal assemblies of the present application according to an example embodiment.
Figure 12B:
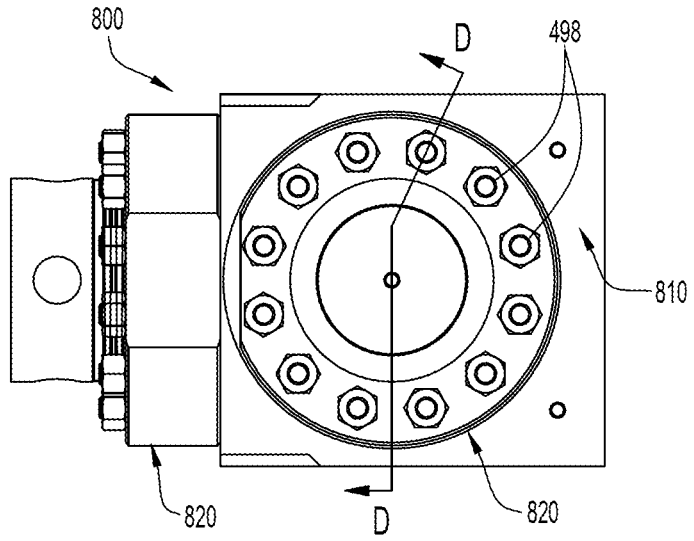
FIG. 12B is a top view of the casing module of FIG. 12A.
Figure 12C:
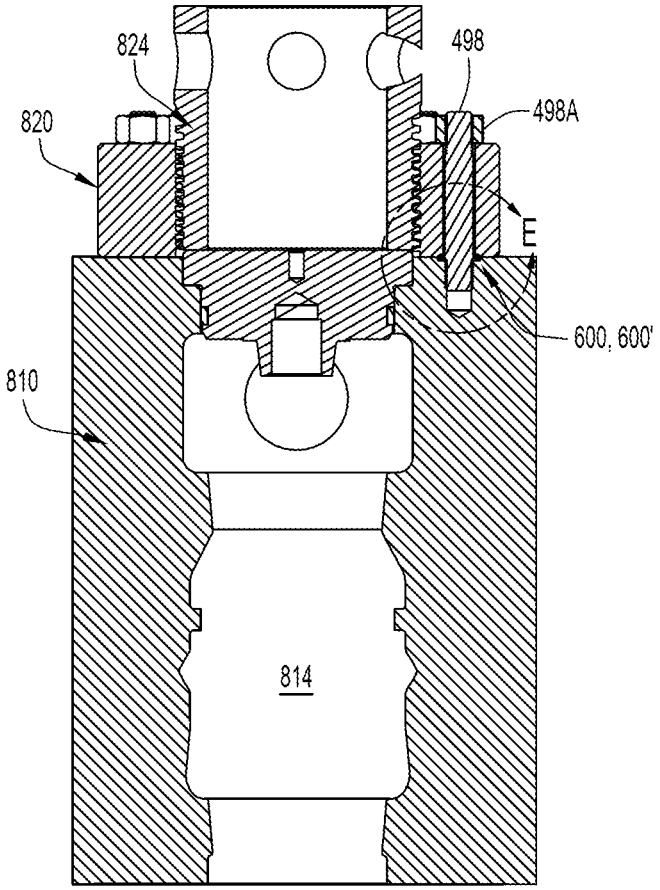
FIG. 12C is a cross-sectional view of the casing module of FIG. 12A taken along line D-D of FIG. 12B.
Figure 12D:
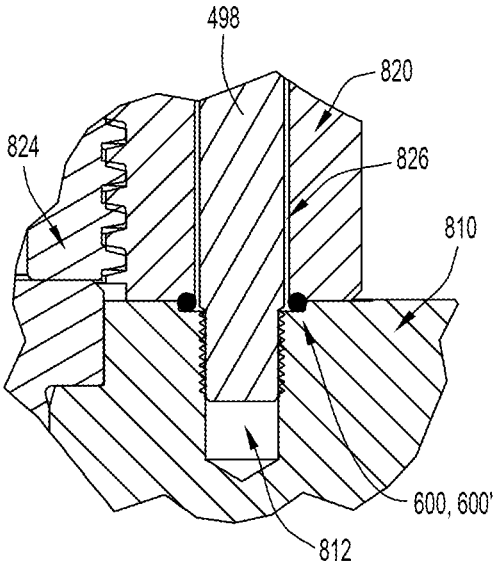
FIG. 12D is a detail view of region E of FIG. 12C.

Overall, the sealing assembly 600, 600' may be disposed about any coupler opening (e.g., openings 204, 212, 222, 326, 328, 410, 420, 620) on any body (e.g., casing 206, stuffing box 330, frame 368, mount plate 400, body 610 mating body 612, casing module 800) or coupler head (e.g., bolt head or nut 498A) to protect any coupler (e.g., coupler 490, 492, 494, 496, 498) from fluid contamination. By preventing the fluid from contacting the coupler, the sealing assembly 600, 600' avoids corrosion and extends the life the couplers. Consequently, time between maintenance for coupler replacement is increased and the cost to replace and install new couplers is reduced. As further examples of coupler openings that can receive sealing assembly 600 or sealing assembly 600', FIGS. 12-12D and 13 depict two additional embodiments, but these are merely two examples of scenarios in which sealing assembly 600 and/or sealing assembly 600'may be used.

Referring to FIGS. 12A-12D, a casing module 800 for forming a fluid end casing is illustrated having the sealing assembly 600, 600' for preventing a fluid from contacting a coupler. The casing module 800 may be an inlet casing module, a discharge casing module, and/or other module that guides a fluid. The casing module 800 includes a main body 810 defining a bore 814 and flanges 820 mounted to the main body 810. Each flange 820 threadably receives a retainer 824 (for retaining and securing a plug, cover, sleeve, or the like) and is mounted to the main body 810 via a plurality of couplers 498. The couplers 498 extend through through-holes 826 in the flange 820 and engage a threaded opening 812. In some embodiments, a nut 498A threadably couples to each coupler 498 to prevent the flange 820 and retainer 824 from sliding off the coupler 498 and main body 810. However, in other embodiments, couplers 498 may be on-piece (e.g., bolts). In any case, the sealing assembly 600, 600' surrounds the threaded opening 812 between the flanges 820 and the main body 810. Thus, the sealing assembly 600, 600' prevents fluid leaking from the bore 814 or from an exterior surface of the casing module 800 to enter the threaded opening 812 and contacting the 498. Accordingly, the sealing assembly 600, 600' prevents corrosion of the couplers 498 from fluids.

Figure 13:
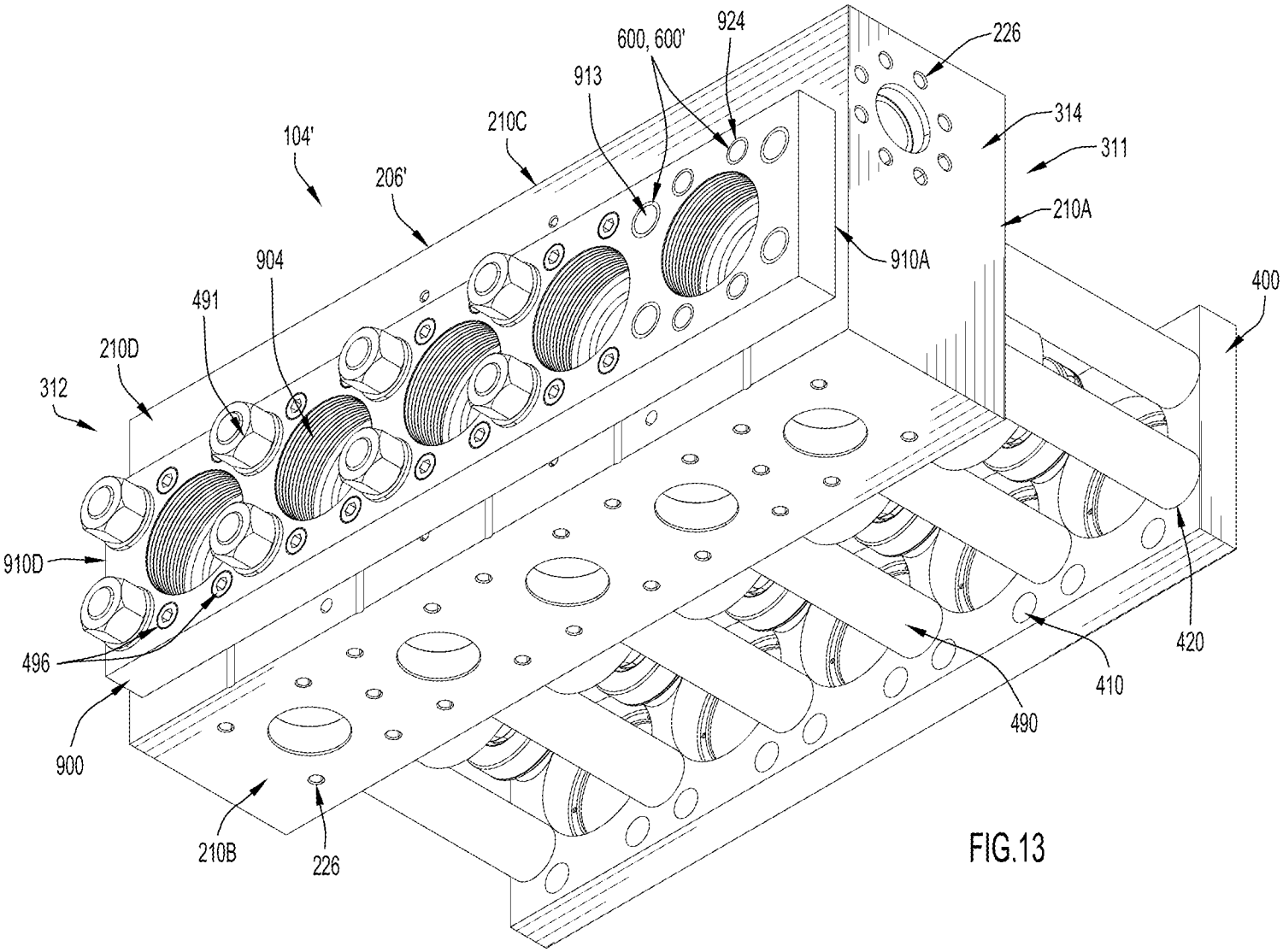
FIG. 13 depicts a bottom perspective view of another embodiment of a fluid end with one or more sealing assemblies of the present application, according to an example embodiment.

Meanwhile, FIG. 13 depicts a bottom, perspective view of another embodiment of a fluid end 104' with sealing assemblies 600, 600'. This embodiment is substantially similar to the fluid end 104 depicted in prior Figures (e.g., in FIG. 5) and is thus labeled with like part numbers, but now the fluid end 104' is formed from two fluid end bodies: a first fluid end body in the form of casing 206' and a second fluid end body 900 in the form of a plate. As has been mentioned repeatedly, with the techniques presented herein, any part or component of a reciprocating pump may include sealing assemblies 600, 600'. Thus, here, second fluid end body 900 and/or the first fluid end body 206' may include sealing assemblies 600, 600'.

More specifically, the second fluid end body 900 may extend from a front surface 910D to a rear surface 910A and the rear surface 910 may be positioned proximate (i.e., flush against or near) the front surface 210D of the casing 206' to form the front side 312 of the fluid end 104'. The second fluid end body 900 includes coupler opening 924 that can each receive a coupler 496. Additionally or alternatively, the second fluid end body 900 can include through holes 913 configured to receive couplers 490. Thus, sealing assemblies 600, 600' installed around a coupler opening 924 or a through hole 913 can serve to prevent fluid from contacting one of couplers 496 or couplers 490, respectively, reducing corrosion and extending the life of that coupler, as is detailed above.

In the depicted embodiment, the coupler openings 924 and holes 913 are arranged around threaded retainer holes 904. The retainer holes 904 are configured to receive a retainer that secures a plug in the casing 206' when the plate 900 is secured to the casing 206' (e.g., by installing couplers 496 into casing 206 via coupler openings 924). However, in other embodiments, the second fluid end body 900 could include any arrangement of coupler openings 924, 913, with or without threaded retainer holes 904. Moreover, the second fluid end body 900 need not be positioned proximate the front external surface 210D of the casing 206' and, for example, could be positioned proximate the top external surface 210C of the casing 206' (e.g., to serve the same purpose of securing retainers, but in a different bore segment of the casing 206').

Still further, in FIG. 13, one set of securing elements 491 and one set of coupler 496 are removed so that sealing assemblies 600, 600' are only seen on one subset of the coupler openings 924 and one subset of holes 913 included on plate 900. This is merely for illustrative purposes and the depicted embodiment may include sealing assemblies 600, 600' across all of the openings 924 and holes 913. Other embodiments, however, need not include sealing assemblies 600, 600' across all of the openings 924 and holes 913 and can include sealing assemblies 600, 600' across any combination of openings 924 and/or holes 913.

Each example embodiment disclosed herein has been included to present one or more different features. However, all disclosed example embodiments are designed to work together as part of a single larger system or method. This disclosure explicitly envisions compound embodiments that combine multiple previously-discussed features in different example embodiments into a single system or method.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the sealing assembly 600, 600' described herein, or portions thereof, may be fabricated from any suitable material or combination of materials, such as plastic, foamed plastic, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Reference may be made to the spatial relationships between various components and to the spatial orientation of various aspects of components as depicted in the attached drawings. However, as will be recognized by those skilled in the art after a complete reading of the present disclosure, the devices, components, members, apparatuses, etc. described herein may be positioned in any desired orientation. Thus, the use of terms such as "above," "below," "upper," "lower," "top," "bottom," or other similar terms to describe a spatial relationship between various components or to describe the spatial orientation of aspects of such components, should be understood to describe a relative relationship between the components or a spatial orientation of aspects of such components, respectively, as the components described herein may be oriented in any desired direction. When used to describe a range of dimensions and/or other characteristics (e.g., time, pressure, temperature, distance, etc.) of an element, operations, conditions, etc., the phrase "between X and Y" represents a range that includes X and Y.

For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment.

Further, the present disclosure may repeat reference numerals and/or letters in the various examples. This repetition is for the purpose of simplicity and clarity and does not in itself dictate a relationship between the various embodiments and/or configurations discussed.

Similarly, when used herein, the term "comprises" and its derivations (such as "comprising," etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is, a deviation within reasonable limits from an exact value should be accepted, because a skilled person in the art will understand that such a deviation from the values indicated is inevitable due to measurement inaccuracies, etc. The same applies to the terms "about" and "around" and "substantially".

As used herein, unless expressly stated to the contrary, use of the phrase "at least one of," "one or more of," "and/or," variations thereof, or the like are open-ended expressions that are both conjunctive and disjunctive in operation for any and all possible combination of the associated listed items. For example, each of the expressions "at least one of X, Y and Z," "at least one of X, Y or Z," "one or more of X, Y and Z," "one or more of X, Y or Z" and "X, Y and/or Z" can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Additionally, unless expressly stated to the contrary, the terms "first," "second," "third," etc., are intended to distinguish the particular nouns they modify (e.g., element, condition, node, outlet, inlet, valve, module, activity, operation, etc.). Unless expressly stated to the contrary, the use of these terms is not intended to indicate any type of order, rank, importance, temporal sequence, or hierarchy of the modified noun. For example, "first X" and "second X" are intended to designate two "X" elements that are not necessarily limited by any order, rank, importance, temporal sequence, or hierarchy of the two elements. Further as referred to herein, "at least one of" and "one or more of" can be represented using the "(s)" nomenclature (e.g., one or more element(s)).

The invention claimed is:

1. A fluid end for a reciprocating pump, comprising:

a fluid end body configured to guide a fluid from an inlet bore to an outlet bore as a power end drives motion of a reciprocating element in or adjacent a reciprocation bore of the fluid end body, the fluid end body including a coupler opening disposed on an external surface of the fluid end body and a groove comprising a counterbore that extends around the coupler opening at the external surface; and a sealing assembly disposed around the coupler opening disposed on the external surface of the fluid end body, the sealing assembly including a compliant member that forms a seal restricting leaked fluid from entering the coupler opening and corroding a coupling element installed therein.

2. The fluid end of claim 1, further comprising:

a component that is removably coupled to the fluid end body; and the coupling element engages the coupler opening to at least partially secure the component to the fluid end body.

3. The fluid end of claim 2, wherein the component comprises a stuffing box.

4. The fluid end of claim 2, wherein the coupler opening is disposed on a rear surface of the fluid end body, a front surface of the fluid end body, a top surface of the fluid end body, or a bottom surface of the fluid end body.

5. A reciprocating pump, comprising:

a power end configured to generate power sufficient for pumping a fluid;

a fluid end body configured to guide the fluid from an inlet bore to an outlet bore as the power end drives motion of a reciprocating element in or adjacent a reciprocation bore of the fluid end body, the fluid end body including a coupler opening disposed on an external surface of the fluid end body and a groove comprising a counterbore that extends around the coupler opening at the external surface; and a sealing assembly disposed around the coupler opening disposed on the external surface of the fluid end body, the sealing assembly restricting leaked fluid from entering the coupler opening and corroding a coupling element installed therein.

6. The reciprocating pump of claim 5, further comprising: the coupling element engages the coupler opening to at least partially secure the fluid end body to the power end.

7. The reciprocating pump of claim 5, wherein the coupler opening is disposed on a rear surface of the fluid end body, a front surface of the fluid end body, a top surface of the fluid end body, or a bottom surface of the fluid end body.

8. A fluid end body for a reciprocating pump, comprising:

coupler openings that open at an exterior surface of the fluid end body, the coupler openings being configured to receive couplers to secure at least one component to the fluid end body; and grooves that extend around one or more coupler openings of the coupler openings at the exterior surface of the fluid end body, wherein each of the grooves is configured to receive a compliant member that forms a seal around a particular coupler of the couplers installed in a particular coupler opening of the coupler openings, wherein each of the grooves comprises a counterbore.

9. The fluid end body of claim 8, wherein the fluid end body comprises a casing that defines an inlet bore, an outlet bore, and a reciprocation bore, and the fluid end body is configured to guide a fluid from the inlet bore to the outlet bore as a power end drives motion of a reciprocating element in or adjacent the reciprocation bore of the fluid end body.

10. The fluid end body of claim 9, wherein the inlet bore, the outlet bore, and the reciprocation bore define at least a portion of a bore pair and the fluid end body further defines additional bore pairs.

11. The fluid end body of claim 9, wherein the inlet bore and the outlet bore are aligned on a common central axis.

12. The fluid end body of claim 9, wherein the at least one component comprises a stuffing box that is removably attachable to the exterior surface of the fluid end body and the coupler openings are usable to secure the fluid end body to the stuffing box when the stuffing box is aligned with the reciprocation bore.

13. The fluid end body of claim 12, wherein the coupler openings surround the reciprocation bore.

14. The fluid end body of claim 8, wherein coupling the at least one component to the fluid end body defines a weep path configured to guide fluid and the compliant member prevents the fluid in the weep path from entering the one or more coupler openings.

15. The fluid end body of claim 8, wherein the coupler openings are usable to couple the fluid end body to a power end with which a fluid end including the fluid end body is operating, such that the at least one component comprises the power end.

16. The fluid end body of claim 8, wherein the one or more coupler openings are disposed on a rear surface of the fluid end body, a front surface of the fluid end body, or both.

17. The fluid end body of claim 8, wherein the one or more coupler openings are disposed on a top surface of the fluid end body, a bottom surface of the fluid end body, or both.

18. The fluid end body of claim 8, wherein the compliant member is an O-ring.

19. The fluid end body of claim 8, wherein the counterbore of each of the grooves has a dovetail shape that retains the compliant member in each groove.

20. The fluid end body of claim 19, wherein the dovetail shape defines a space that guides fluid away from the one or more coupler openings.

* * * * *